US007696942B2

(12) United States Patent
Kim et al.

(10) Patent No.: US 7,696,942 B2
(45) Date of Patent: Apr. 13, 2010

(54) SLOT ANTENNA

(75) Inventors: Il-kyu Kim, Seongnam-si (KR); Young-eil Kim, Suwon-si (KR); Chang-won Jung, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/014,252

(22) Filed: Jan. 15, 2008

(65) Prior Publication Data

US 2009/0033577 A1 Feb. 5, 2009

(30) Foreign Application Priority Data

Jul. 30, 2007 (KR) ..... 10-2007-0076543

(51) Int. Cl.

*H01Q 13/10* (2006.01)
*H01Q 1/38* (2006.01)
*H01Q 5/00* (2006.01)
*H01Q 9/04* (2006.01)

(52) U.S. Cl. ..... 343/767; 343/700 MS

(58) Field of Classification Search ..... 343/767–771, 343/700 MS

See application file for complete search history.

(56) References Cited

U.S. PATENT DOCUMENTS 5,748,153 A * 5/1998 McKinzie et al. ..... 343/767
7,355,559 B2 * 4/2008 Tikhov et al. ..... 343/895
2002/0000943 A1 * 1/2002 Oberschmidt et al. ..... 343/767
2008/0001837 A1 * 1/2008 Liu ..... 343/767

OTHER PUBLICATIONS

Jeon et al. "Novel Broadband Strip Line Fed Slot Antenna for 5GHz Applications" IEEE Antennas and Propagation Society International Symposium, Jun. 2003, pp. 28-31, vol. 3, New York.
Zulkifi et al. "Dual Band Microstrip Antenna Using U and S Slots for WLAN Application" IEEE Antennas and Propagation International Symposium, Jun. 2007, pp. 2049-2052.
Wi et al. "Package-Level Integrated LTCC Antenna for RF Package Application" IEEE Transactions on Advanced Packaging, Feb. 2007, pp. 132-141, vol. 30, No. 1.
Hong et al. "Design of Tri-band Reconfiguration Active RFID Antenna" IEEE Antennas and Propagation International Symposium, Jun. 2007, pp. 117-120.

* cited by examiner

*Primary Examiner*—Vibol Tan
*Assistant Examiner*—Dylan White
(74) *Attorney, Agent, or Firm*—Sughrue Mion, PLLC

(57) ABSTRACT

A slot antenna is provided. The slot antenna includes a feeding unit of a strip line shape which is disposed on a first surface of a substrate, a ground which is disposed on a second surface of the substrate, and an antenna element which is formed by connecting two sub slots formed on the second surface of the substrate, wherein each of the sub slots is arranged at an edge of the ground in an internal direction of the ground. Accordingly, the size of the antenna is reduced, and more area is provided for arranging components of a terminal.

13 Claims, 5 Drawing Sheets

SLOT ANTENNA

CROSS-REFERENCE TO RELATED APPLICATIONS

This application claims priority under 35 U.S.C. §119 from Korean Patent Application No. 10-2007-0076543, filed on Jul. 30, 2007, in the Korean Intellectual Property Office, the disclosure of which is incorporated herein by reference in its entirety.

BACKGROUND OF THE INVENTION

1. Field of the Invention

Apparatuses consistent with the present invention relate to an antenna, and more particularly, to a slot antenna.

2. Description of the Related Art

The recent development of information communication technology has brought a portable mobile communication terminal capable of wireless communication any time and any place. The portable mobile communication terminal may include mobile phone, handheld personal computer (HPC), personal digital assistants (PDA), and digital multimedia broadcasting (DMB).

The portable mobile communication terminal for wireless communication includes necessarily an antenna to enhance communication sensitivity, which receives an electric wave or signal from an external source, and transmits a signal received from interior devices to the external source. The antenna transmits and receives the signal to and from a base station.

Such an antenna mainly uses a projecting external antenna such as a monopole antenna or helical antenna. However, the projecting external antenna has several disadvantages such as susceptibility to breakage or damages due to external impacts, uncomfortable when installed within a device which is being carried, and it degrades the appearance of the device.

An antenna has thus been inserted in mobile phones to solve the above disadvantages. Such an internal antenna, or Intenna includes meander line monopole antennas (MLMA), inverted F antennas (IFA), and planar inverted F antennas (PIFA).

However, the internal antenna has a problem in that a terminal housing the internal antenna is required to have a size large enough to hold the antenna therein. Furthermore, other components of the terminal are limited due to the presence of antenna.

SUMMARY OF THE INVENTION

Exemplary embodiments of the present invention address at least the above problems and/or disadvantages and other disadvantages not described above. Also, the present invention is not required to overcome the disadvantages described above, and an exemplary embodiment of the present invention may not overcome any of the problems described above.

The present invention provides an antenna which enables components housed in a miniature terminal to be designed with improved degrees of freedom because the size of antenna elements is reduced.

According to an exemplary embodiment of the present invention, there is provided an antenna comprising a feeding unit of a strip line shape which is disposed on a first surface of a substrate; a ground which is disposed on a second surface of the substrate; and an antenna element which is formed by connecting two sub slots formed on the second surface of the substrate, wherein each of the sub slots is arranged at an edge of the ground in an internal direction of the ground.

The antenna element may comprise a first sub slot in which one end is formed at the end of the ground, and an opposite end is formed inside the ground; and a second sub slot in which one end is formed at the end of the ground, and an opposite end is formed inside the ground, wherein one end of the first sub slot is connected with one end of the second sub slot at the edge of the ground, and the opposite ends of the first and second sub slots are distanced apart from each other inside of the ground.

The first sub slot may be symmetrical to the second sub slot based on the feeding unit.

The first and second sub slots may have a strip line shape, and the first sub slot is perpendicular to the second sub slot.

The first and second sub slots may be in a strip line shape bent at least once.

The first and second sub slots may be in a round shape, and are bent toward the feeding unit.

The length of the feeding unit may be longer than the length of the ground.

BRIEF DESCRIPTION OF THE DRAWINGS

The above and/or other aspects of the present invention will be more apparent by describing certain exemplary embodiments of the present invention with reference to the accompanying drawings, in which.

DETAILED DESCRIPTION OF EXEMPLARY EMBODIMENTS OF THE INVENTION

Figure 1A:
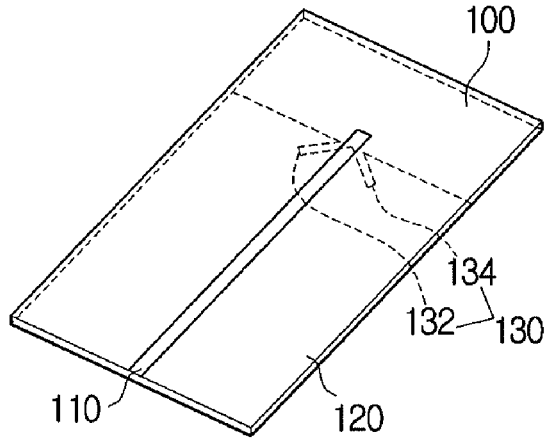
FIGS. 1A to 1C are schematic diagrams illustrating a miniaturized antenna according to an exemplary embodiment of the present invention.

Certain exemplary embodiments of the present invention will now be described in greater detail with reference to the accompanying drawings.

In the following description, same drawing reference numerals are used for the same elements even in different drawings. The matters defined in the description, such as detailed construction and elements, are provided to assist in a comprehensive understanding of the invention. Thus, it is apparent that the present invention can be carried out without those specifically defined matters. Also, well-known functions or constructions are not described in detail since they would obscure the invention with unnecessary detail.

Figure 1B:
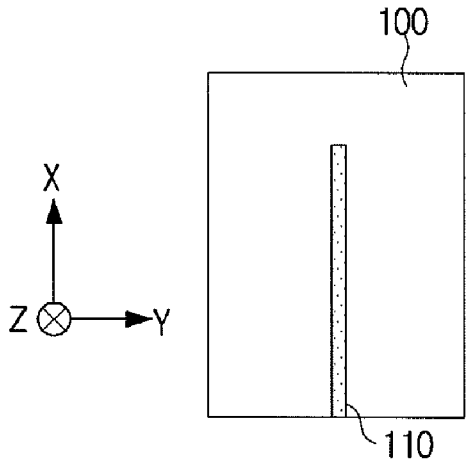
Figure 1C:
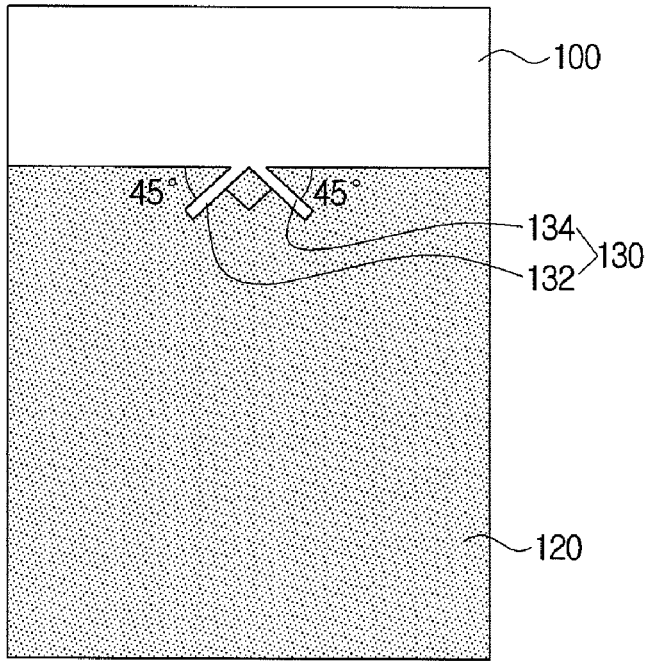

FIGS. 1A to 1C are schematic diagrams illustrating a miniaturized antenna according to an exemplary embodiment of the present invention. FIG. 1A is a three dimensional view illustrating a miniaturized antenna which is printed on a substrate according to an exemplary embodiment of the present invention, FIG. 1B is an elevational view of the antenna of FIG. 1A, and FIG. 1C is a rear elevation of the antenna of FIG. 1A.

In an exemplary embodiment, the miniaturized antenna is disposed inside the housing of a device, such as a mobile communication device.

Referring to FIG. 1B, a feeding unit 110 of a strip line shape is provided on a face surface of a substrate 100. The feeding unit 110 is disposed in a length (X) direction of the substrate 100, and may be longer than a ground 120 which will be explained below. The feeding unit 110 receives a current from an external source, and executes coupling so that antenna elements 130 disposed in an internal segment of the ground 120 receive electric current.

Referring to FIG. 1C, the ground 120 occupies most of the substrate 100, and the antenna elements 130 are arranged in an inclined manner at the edge of the ground 120, both on the reverse side of the substrate 100.

The length (X) of the ground 120 may be shorter than the length (X) of the substrate 100, and the width (Y) of the ground 120 may be the same as the width (Y) of the substrate 100. Since the length (X) of the ground 120 is shorter than the length of the feeding unit 110, the coupling is performed more easily. Therefore, the antenna elements 130 may receive electric current.

The antenna element 130 has a slot shape, and comprises a first sub slot 132 and a second sub slot 134 which are arranged at an upper end edge of the ground 120 in an internal direction of the ground 120. Because the first and second sub slots 132, 134 are inclined with respect to a width direction (Y) at the upper end edge of the ground 120, the first and second sub slots 132, 134 are referred to as an inclined slot.

One end of the first sub slot 132 is disposed at the upper end edge of the ground 120, and an opposite end of the first sub slot 132 is disposed inside the ground 120. One end of the second sub slot 134 is disposed at the upper end edge of the ground 120, and an opposite end of the second sub slot 134 is disposed inside the ground 120. The first sub slot 132 may be arranged symmetrically to the second sub slot 134 based on an axis passing the center of the ground 120. The length of the first and second sub slots 132, 134 may be a quarter of the wavelength of an operating electromagnetic wave.

More particularly, one end of the first sub slot 132 and one end of the second sub slot 134 are open at the upper edge of the ground 120. These open ends of the first and second sub slot 132, 134 receive a current from the feeding unit 110 which is arranged on a face surface of the substrate 100. The opposite end of the first sub slot 132 is formed apart from the opposite end of the second sub slot 134 inside the ground 120.

The first sub slot 132 may be inclined at an angle of 45 degrees with respect to a width side of the ground 120, and the second sub slot 134 may also be inclined at an angle of 45 degrees with respect to the width side of the ground 120, so that the first sub slot 132 can maintain an acute angle with the second sub slot 134. However, it is not necessary that the first sub slot 132 is perpendicular to the second sub slot 134. The arrangement of the first and second sub slots 132, 134 may be adjusted according to an arrangement of a circuit provided on the substrate 100.

The first and second sub slots 132, 134 may operate as one antenna element 130, which resonates in 5.4 GHz to 5.9 GHz band in the same operating principle as that of the dipole antenna. A resonant electromagnetic wave basically shows a forward beam pattern.

By simply forming the antenna element 130 of a slot shape at the edge of the ground 120 as explained the above, the antenna may be constructed, which operates as efficiently as an antenna positioned at the edge of the ground 120. Because the slot inclinedly disposed at the edge of the ground 120 operates as an antenna, designing a terminal is simplified, and high gain and forward beam pattern are acquired.

Figure 2:
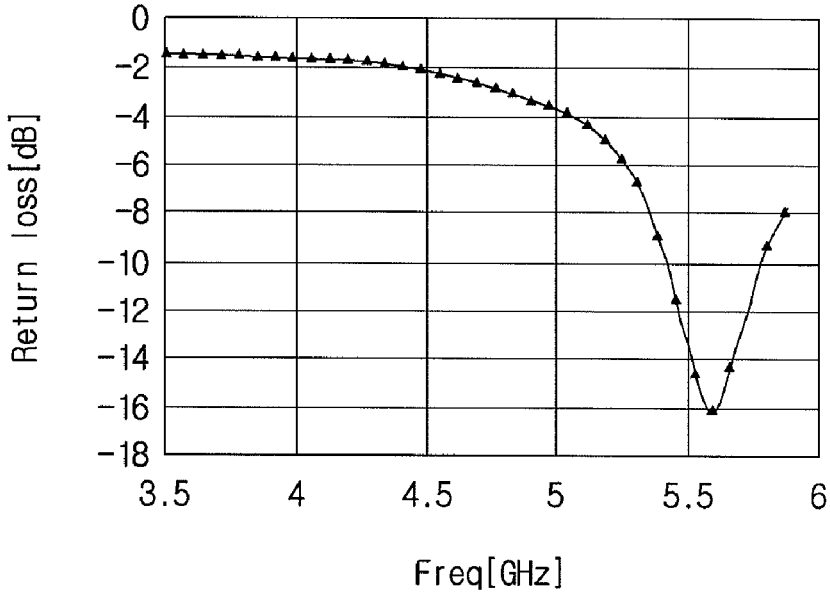
FIG. 2 is a graph illustrating a return loss of a slot antenna.

FIG. 2 is a graphical representation of a return loss of a slot antenna. Less return loss indicates that a slot antenna performs the function of the antenna element 130 more efficiently. Referring to FIG. 2, the slot antenna is operated as an antenna at 5.5 GHz band.

Figure 3A:
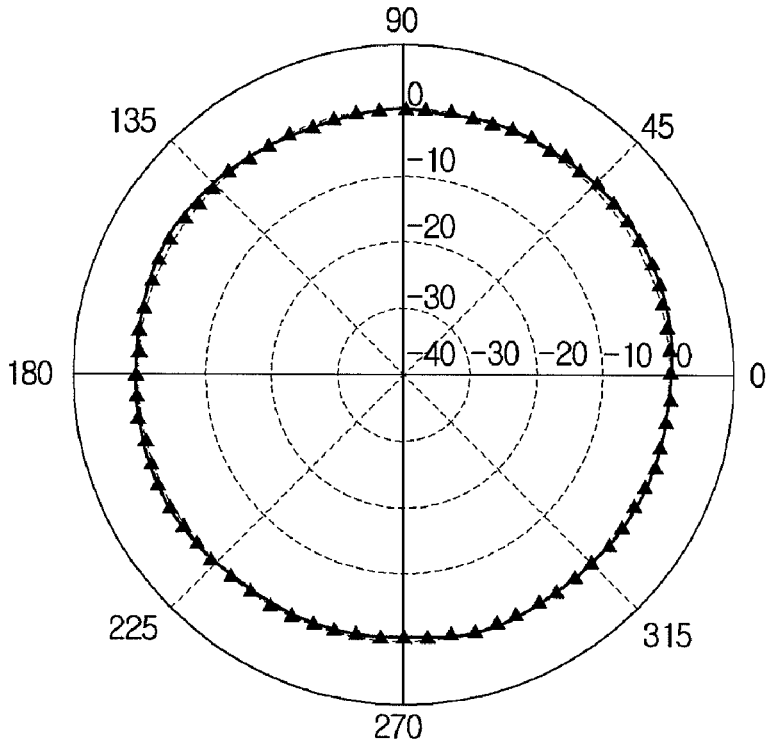
FIGS. 3A and 3B are graphs illustrating a radiation pattern of a slot antenna.
Figure 3B:
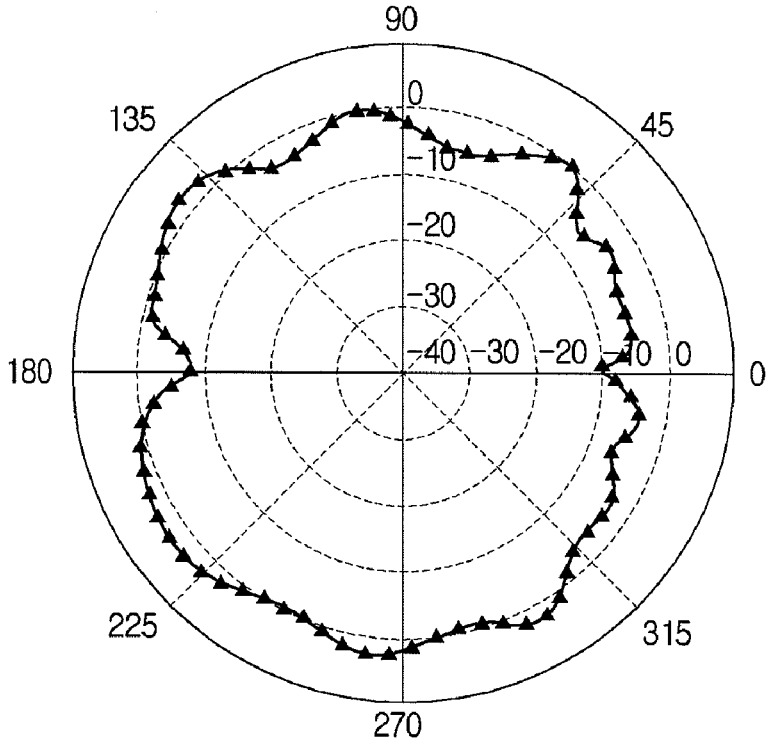

FIGS. 3A and 3B are graphical representations of a radiation pattern of a slot antenna. FIG. 3A is a graphical representation of a beam pattern of an electromagnetic wave which is radiated through a slot antenna on an elevation plane (XY) of the substrate 100, and FIG. 3B is a graphical representation of a beam pattern of an electromagnetic wave which is radiated through a slot antenna on an azimuth plane (YZ) of the substrate 100. Definition of the elevation plane (XY) and azimuth plane (YZ) is illustrated in FIG. 1B. FIGS. 3A and 3B show the radiation pattern of the electromagnetic wave resonating through the slot antenna is in a forward direction.

FIGS. 4A to 4D are views illustrating a slot antenna according to another exemplary embodiment of the present invention. While the substrate 100 is depicted as having the feeding unit 110, the ground 120, and the antenna elements 130 all formed thereon for a convenient description, the feeding unit 110 is indeed disposed on one face of the substrate 100, and the ground 120 and the antenna element 130 are disposed on the reverse surface of the substrate 100. The entire length of the antenna element 130 is a half of the wave of the operating electromagnetic wave, and a quarter of the wave of the operating electromagnetic wave may be symmetrically arranged based on the feeding unit 110.

Figure 4A:
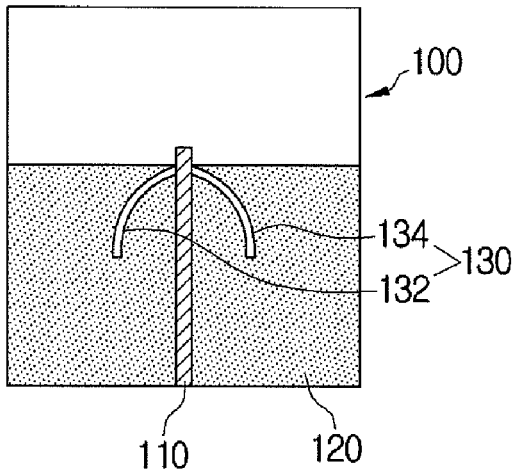
FIGS. 4A to 4D are views illustrating a slot antenna according to another exemplary embodiment of the present invention.
Figure 4B:
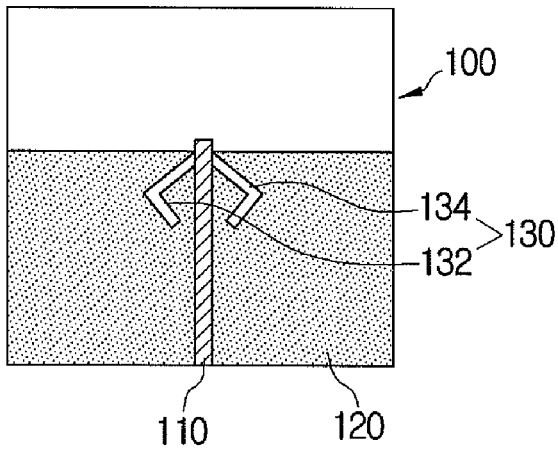
Figure 4C:
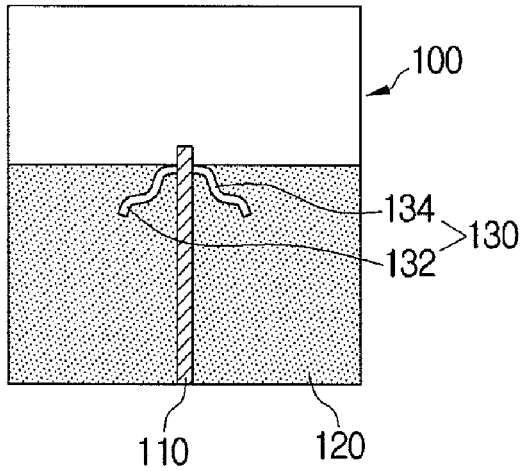
Figure 4D:
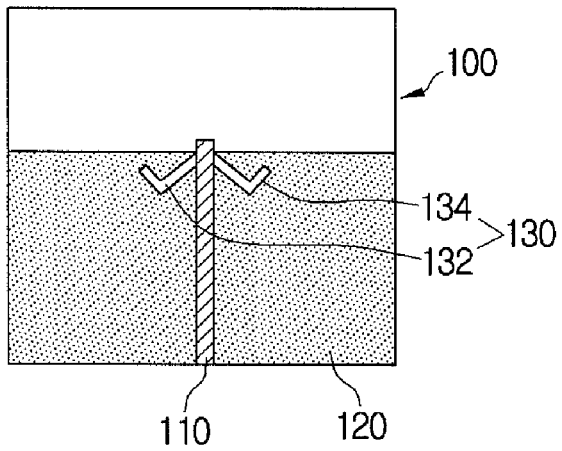

The sub slot may not necessarily have a strip line shape as illustrated in FIG. 4A. That is, the sub slot may have a round shape. If the sub slot has a round shape, the sub strip may be bent toward the feeding unit 110. If the sub slot has a strip line shape as illustrated in FIGS. 4B to 4D, the sub strip may be bent more than once, with varying degrees of inclination. However, either bent shape or round shape, the sub slot is desirably symmetrical to each other based on the feeding unit 110, with one end of the first sub slot 132 and one end of the second sub slot 134 open at the edge of the ground 120.

Because the first and second sub slots 132, 134 are disposed at the edge of the ground 120, a larger area is provided for arranging components of a terminal. Furthermore, the sub slots operate as efficiently as an antenna mounted at an upper portion of the terminal.

While a related art antenna of terminal is disposed at the edge of the ground 120, and the sub slots are disposed at the edge of the ground 120 according to an exemplary embodiment of the present invention. Accordingly, the sub slot has a similar feature to the related art antenna, and also has improved space utilization of the substrate 100 as other components housed in the terminal can be arranged at the center of the ground 120.

Because a related art slot antenna has to use the substrate 100 having a plurality of layers, and requires an antenna printed separately from the ground 120, the fabrication cost is high. However, because an antenna according to the exemplary embodiments of the present invention is fabricated on a printed circuit board (PCB) substrate, the fabrication costs decreases.

In conclusion, the size of the antenna is reduced according to the exemplary embodiment of the present invention, because slots are arranged at the edge of the ground. Therefore, components are housed in a miniature terminal with improved degrees of freedom.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. An antenna comprising:

a feeding unit of a strip line shape which is disposed on a first surface of a substrate;

a ground which is disposed on a second surface of the substrate; and an antenna element which is formed by connecting two sub slots formed on the second surface of the substrate, wherein each of the two sub slots is arranged at an edge of the ground in an internal direction of the ground, wherein the edge of the ground separates the second surface of the substrate into a first portion on which the ground is formed and a second portion on which the ground is not formed.

2. The antenna of claim 1, wherein the two sub slots of the antenna element comprises:

a first sub slot in which a first end of the first sub slot is formed at the edge of the ground, and a second end of the first sub slot is formed inside the ground; and a second sub slot in which a first end of the second sub slot is formed at the edge of the ground, and a second end of the second sub slot is formed inside the ground, wherein the first end of the first sub slot is connected with the first end of the second sub slot at the edge of the ground, and the second end of the first and the second end of the second sub slot are disposed apart from each other inside of the ground.

3. The antenna of claim 2, wherein the first sub slot is symmetrical to the second sub slot based on the feeding unit.

4. The antenna of claim 2, wherein the first and the second sub slots have a strip line shape, and the first sub slot is perpendicular to the second sub slot.

5. The antenna of claim 2, wherein the first and the second sub slots are formed in a strip line shape bent at least once.

6. The antenna of claim 2, wherein the first and the second sub slots are formed in a round shape, and are bent toward the feeding unit.

7. The antenna of claim 2, wherein the first and the second sub slots operate as one antenna element resonating in 5.4 GHz and 5.9 GHz band.

8. The antenna of claim 2, wherein the first and the second sub slots have mirror symmetry.

9. The antenna of claim 1, wherein the feeding unit, the ground, and the antenna element are disposed inside a housing.

10. The antenna of claim 1, wherein the first portion of the second surface of the substrate and the second portion of the second surface of the substrate are divided along a direction substantially parallel with the strip line shape of the feeding unit.

11. The antenna of claim 1, wherein the first and the second portions of the second surface of the substrate are substantially parallel with a plane formed by the two sub slots.

12. An antenna comprising:

a feeding unit of a strip line shape which is disposed on a first surface of a substrate;

a ground which is disposed on a second surface of the substrate; and an antenna element which is formed by connecting two sub slots formed on the second surface of the substrate, wherein each of the two sub slots is arranged at an edge of the ground in an internal direction of the ground, and wherein a length of the feeding unit is longer than a length of the ground.

13. An antenna comprising:

a feeding unit of a strip line shape which is disposed on a first surface of a substrate;

a ground which is disposed on a second surface of the substrate; and an antenna element which is formed by connecting two sub slots formed on the second surface of the substrate, wherein each of the two sub slots is arranged at an edge of the ground in an internal direction of the ground, and wherein bases of the first and the second sub slots extend out from the feeding unit, and distal ends of the first and the second sub slots extend toward the feeding unit.

* * * * *